United States Patent [19]

Tanaka et al.

[11] Patent Number: 4,660,527

[45] Date of Patent: Apr. 28, 1987

[54] CYLINDER HEAD FOR COMBUSTION ENGINE

[75] Inventors: Fusatoshi Tanaka, Higashihiroshima; Shuichi Nakatani, Hiroshima; Hideo Nakayama, Hiroshima; Hiroyuki Hanafusa, Hiroshima, all of Japan

[73] Assignee: Mazda Motor Corporation, Hiroshima, Japan

[21] Appl. No.: 871,778

[22] Filed: Jun. 9, 1986

[30] Foreign Application Priority Data

Jun. 12, 1985 [JP] Japan ..... 60-89310[U]

[51] Int. Cl.[4] ..... F01P 3/02

[52] U.S. Cl. ..... 123/41.82 R; 123/193 H

[58] Field of Search ..... 123/41.72, 41.74, 41.82 R, 123/193 H

[56] References Cited

U.S. PATENT DOCUMENTS

| | | | |
|---|---|---|---|
| 3,491,731 | 1/1970 | Dinger et al. | 123/41.82 R |
| 4,083,333 | 4/1978 | Rudert et al. | 123/41.82 R |
| 4,106,444 | 8/1978 | Deutschmann et al. | 123/41.82 R |
| 4,267,811 | 5/1981 | Springer | 123/193 H |
| 4,354,463 | 10/1982 | Otani et al. | 123/308 |
| 4,436,066 | 3/1984 | Formia et al. | 123/41.82 R |

*Primary Examiner*—William A. Cuchlinski, Jr.

*Attorney, Agent, or Firm*—Burns, Doane, Swecker & Mathis

[57] ABSTRACT

A cylinder head construction for a combustion engine, which comprises a wall structure defining a cylinder head lower surface adapted to contact a mating surface of a cylinder block, and having an inwardly recessed wall defining a combustion chamber, an exhaust port defining wall open at one end at said inwardly recessed wall and at the opposite end in a cylinder head side wall, and adapted to be selectively opened and closed by two separate exhaust valves, wherein a pair of exhaust ports, one for each exhaust valve, are defined at least adjacent the exhaust valves, respectively, a coolant passage defined between the wall structure and the exhaust port defining wall, and a wall member extending between the exhaust port defining wall and the wall structure for deflecting a coolant in the coolant passage so as to flow into a space between the exhaust ports.

8 Claims, 4 Drawing Figures

CYLINDER HEAD FOR COMBUSTION ENGINE

BACKGROUND OF THE INVENTION

The present invention generally relates to a cylinder head construction and, more particularly, to a cylinder head construction for an internal combustion engine of DOHC (double-overhead-camshaft) type having a plurality of exhaust ports for each engine cylinder.

Numerous patent literatures including, for example, the U.S. Pat. No. 4,354,468, patented Oct. 19, 1982, disclose an automobile engine having a plurality of exhaust ports for each engine cylinder used for improving both the engine output characteristic and the exhaust efficiency.

As disclosed in, for example, the U.S. Pat. No. 4,267,811, patented May 19, 1981, the cylinder head used in this type of high power engine is of a construction having a plurality of exhaust ports each adapted to be communicated at one end with an associated combustion chamber and at the opposite end with an exhaust manifold, and also having at least exhaust port defining walls and a lower deck with a coolant flow passage defined therebetween.

As is well known to those skilled in the art, the automobile exhaust gases being a product of combustion evolve heat of highly elevated temperature. Accordingly, a portion of the prior art cylinder head between each neighboring exhaust ports is generally susceptible to thermal deformation under the influence of the very hot heat of the exhaust gases flowing through the exhaust ports.

The cylinder head is, when mounted on the mating cylinder block to complete an engine construction, tightly secured to the mating cylinder block by the use of a plurality of bolts. In general, the contact pressure exerted between the cylinder head and the cylinder block is relatively high at a location adjacent and around each bolt used to connect the cylinder head and block together, and it decreases progressively with increase in distance from the respective bolt. In particular, the contact pressure exerted between the cylinder head and the cylinder block is smaller at a portion of the cylinder head intermediate between the neighboring bolts than at the remaining portion thereof, and accordingly, even a slight thermal deformation occurring at that portion of the cylinder head is liable to result in the leakage of a portion of combustion gases from an eventually created gap between the cylinder head and the cylinder block.

SUMMARY OF THE INVENTION

Accordingly, the present invention has been developed with a view to substantially eliminating the above discussed problems and has for its object to provide an improved cylinder head construction for an internal combustion engine wherein improvement has been made to positively cool that portion of the cylinder head between each neighboring exhaust ports and also to increase the sealability between the cylinder head and the cylinder block.

In order to accomplish this object of the present invention, the latter is featured in that a dual-function deflector rib is provided for each paired exhaust ports, which deflector rib does not only connect the exhaust port defining wall and a lower deck of the cylinder head together, but also serve to guide the flow of a coolant water to permit the latter to cool that portion of the cylinder head between the paired exhaust ports.

According to the present invention, since the coolant water used to cool the engine as a whole can, when flowing in the cylinder head, be guided by the deflector rib so as to flow through that portion of the cylinder head between the paired exhaust port for each engine cylinder, and accordingly, that portion of the cylinder head between the paired exhaust ports can be positively cooled to minimize the elevation of temperature under the influence of the exhaust gases.

Moreover, since the lower deck of the cylinder head and the exhaust port defining wall which connects the lower deck and the adjacent side wall of the cylinder head together are connected together by the deflector rib, the rigidity of that portion of the cylinder head between the paired exhaust ports can be increased enough to minimize the thermal deformation thereof which would occur when heated by the exhaust gases of elevated temperature. In this way, the sealability between the cylinder head and the cylinder block can be increased with no substantial possibility of leakage of combustion gases.

BRIEF DESCRIPTION OF THE DRAWINGS

This and other objects and features of the present invention will become readily understood from the following description taken in conjunction with a preferred embodiment with reference to the accompanying drawings, in which.

DETAILED DESCRIPTION OF THE EMBODIMENT

Figure 1:
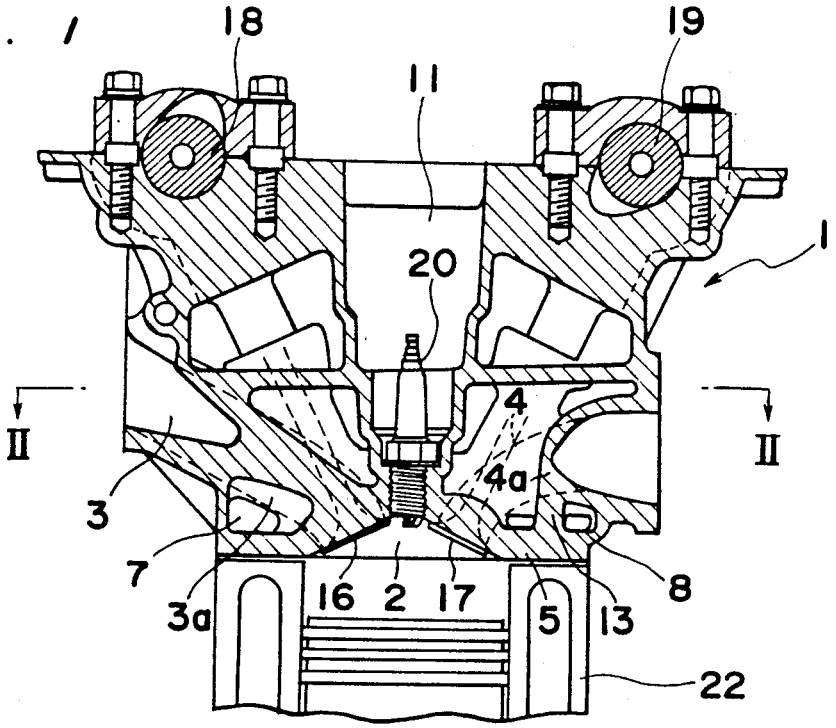
FIG. 1 is an endwise sectional view of a cylinder head as mounted on a cylinder block partially shown therein.
Figure 4:
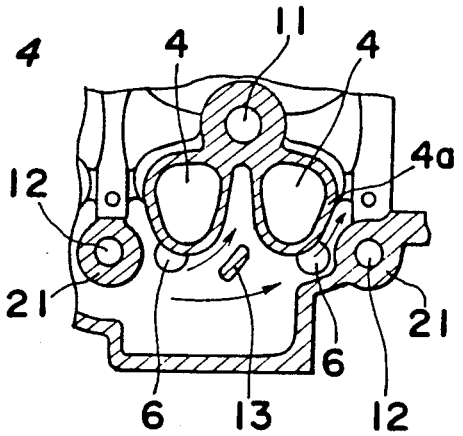
FIG. 4 is a partial cross-sectional view taken along the line IV—IV in FIG. 3.
Figure 3:
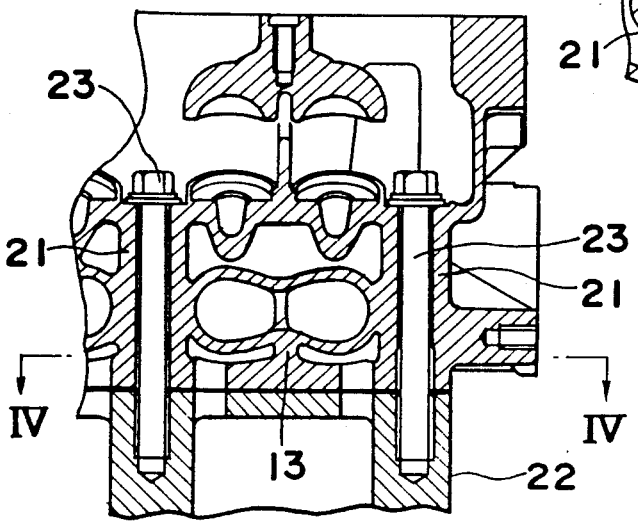
FIG. 3 is a partial cross-sectional view taken along the line III—III in FIG. 2.

Referring to the accompanying drawings, there is shown an internal combustion engine of a type having a pair of exhaust ports for each engine cylinder. The engine comprises a cylinder block 22 having a die-cast cylinder head 1 mounted atop the cylinder block 22 and firmly bolted thereto. The engine so far shown is a four cylinder DOHC engine, and for this purpose, the cylinder head 1 carries a pair of camshafts 18 and 19 for driving intake valves 16 and exhaust valves 17, respectively, generally in opposite sense to each other as is well known to those skilled in the art, said camshafts 18 and 19 being in turn operatively coupled with a crankshaft (not shown) as is also well known to those skilled in the art.

The cylinder head 1 comprises a generally rectangular lower deck 5, a pair of opposite side walls, and front and rear end walls all assembled together by the use of any known metal die casting technique. In alignment with respective engine cylinders in the cylinder block, the lower deck 5 of the cylinder head 1 is formed with combustion chambers 2 recessed inwardly of the cylinder head 1. The cylinder head 1 is formed, for each engine cylinder, with a pair of intake ports 3, open at one end into the respective combustion chamber 2 and at the opposite end in one of the side walls of the cylinder head 1, and also with a pair of exhaust ports 4 open at one end into the respective combustion chamber 2 and at the opposite end in the other of the side walls of the same cylinder head. The intake ports 3 are selectively closed and opened by the associated intake valves 16 whereas the exhaust ports 4 are selectively opened and closed by the associated exhaust valves 17.

Figure 2:
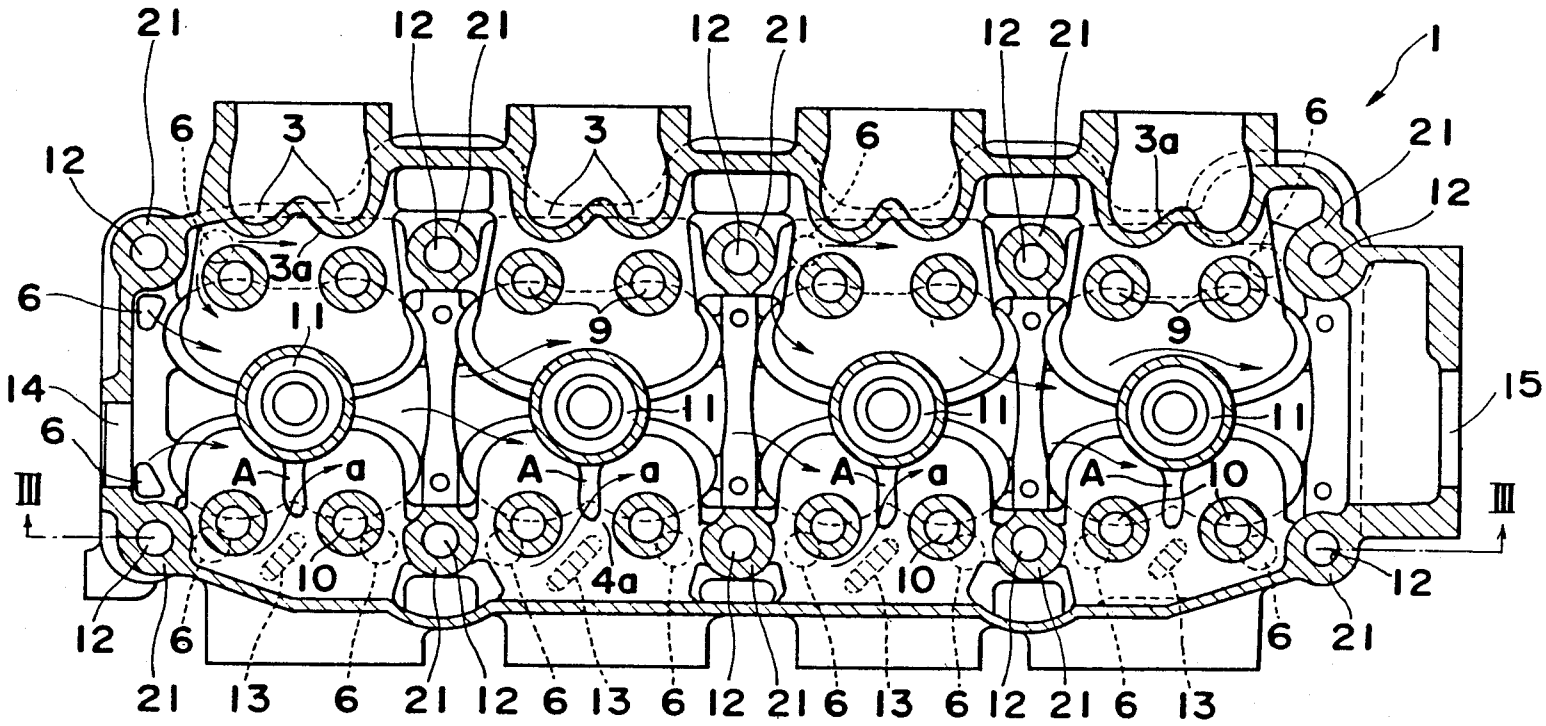
FIG. 2 is a cross-sectional view, on a slightly enlarged scale, of the cylinder head taken along the line II—II in FIG. 1.

As best shown in FIG. 1, coolant passages 7 and 8 which are communicated with each other as shown in FIG. 2, are defined in the cylinder head 1 between the lower deck 5 and intake port defining walls 3*a* and between the lower deck 5 and exhaust port defining walls 4*a*, respectively, so that a coolant water entering coolant inlets 6 defined adjacent the front end wall of the cylinder head 1 can flow through the coolant passages 7 and 8 in a manner as indicated by the arrows in FIG. 2 towards a coolant outlet 15 defined in the rear end wall of the same cylinder head 1, said coolant outlet 15 being in turn fluid-connected with any known radiator (not shown).

A portion of the cylinder head 1 which aligns generally with each pair of the intake ports 3 is formed with a pair of spaced slide holes 9 through which valve stems of the paired intake valves 16 extend for engagement with respective cams on the camshaft 18. Similarly, a portion of the cylinder head 1 which aligns generally with each pair of the exhaust ports 4 is formed with a pair of spaced slide holes 10 through which valve stems of the paired exhaust valves 17 extend for engagement with cams on the camshaft 19.

For each engine cylinder, a spark plug 20 is firmly received in a plug socket 11 with its electrode tip exposed to the respective combustion chamber 22 generally in alignment with the longitudinal axis of the respective engine cylinder, said plug socket 11 being defined between the associated pair of the exhaust valves 17.

The cylinder head 1 is also integrally formed with two rows of tubular walls 21 each having a bolt receiving hole 12 defined therein for the passage therethrough of a respective bolt 23 used to connect the cylinder head and the cylinder block together. These rows of the tubular walls 21 extend in a direction parallel to the longitudinal sense of the engine and positioned respectively adjacent a group of the paired intake valves 16 and a group of the exhaust valves 17, each two neighboring members of the bolt receiving holes 12 in each of said rows being located generally on respective sides of the paired intake or exhaust valves 16 or 17 with respect to the longitudinal sense of the engine. It is, however, to be noted that all of the tubular walls 21 of one of the rows adjacent the group of the exhaust valves 17 are integrally connected with the exhaust port defining walls 4*a*.

The cylinder head 1 also comprises a plurality of deflector ribs 13 extending between the lower deck 5 and the exhaust port defining walls 4*a* so to connect them together, each of said deflector ribs 13 being positioned generally between the paired exhaust ports 4 so that the flow of the coolant water can be deflected so as to orient towards a space A between each paired exhaust ports 4 as shown by the arrows a in FIG. 2.

For the purpose of the manufacture of the cylinder head 1 by the use of any known die casting technique, the cylinder head 1 is formed with an opening 14 in the front end wall, which opening 14 is tightly closed by a blind plug (not shown) during the assembly of the engine to avoid the leakage of the coolant water out from the cylinder head 1.

While the cylinder head according to the present invention is constructed as hereinbefore described, it will readily be seen that the coolant water entering the cylinder head 1 through the coolant inlets 6 flows from front to rear through the coolant passages 7 and 8 as shown by the arrows and is then discharged through the coolant outlet 15 into the radiator for recirculation. The presence of the deflector ribs 13 makes it possible to orient the flow of the coolant water through each space A between the respective paired exhaust ports 4 as shown by the arrows a in FIG. 2, thereby facilitating the cooling of each portion of the cylinder head between the respective paired exhaust ports 17.

Moreover, since while the lower deck 5 and one of the opposite side walls of the cylinder head 1 adjacent the exhaust ports 4 are integrally connected together by means of the exhaust port defining walls 4*a* the exhaust port defining walls 4*a* are in turn integrally connected with the lower deck 5 by means of the deflector ribs 13, respective portions of the cylinder head 1 adjacent the deflector ribs 13 could be imparted an increased rigidity enough to minimize any possible thermal deformation of the lower deck 5, and consequently, the sealability between the lower deck 5 and the cylinder block 22 can be improved.

Furthermore, when the cylinder head 1 is connected with the cylinder block 22 by the use of the bolts 23 inserted in the bolt receiving holes 12 and then firmly threaded into the cylinder block 22, fastening forces exerted by the bolts 23 act on respective portions of the lower deck 5 between each neighboring bolts 23 through the tubular walls 21, the exhaust port defining wall 4*a* and the deflector ribs 13, thereby increasing the sealability between the lower deck 5 of the cylinder head 1 and the cylinder block 22.

From the foregoing, it has now become clear that the increased rigidity of the lower deck of the cylinder head and the increased sealability between the cylinder head and the cylinder block altogether make it possible to avoid any possible leakage of combustion gases through a gap between the cylinder head and the cylinder block.

Although the present invention has fully been described in connection with the preferred embodiment thereof with reference to the accompanying drawings, it is to be noted that various changes and modifications are apparent to those skilled in the art. By way of example, the concept of the present invention can be equally applicable to an internal combustion engine having one intake port for each engine cylinder. Moreover, the number of the engine cylinders may not be limited to a plural number, but may be one. Such changes and modifications are to be understood as included within the scope of the present invention as defined by the appended claims, unless they depart thereform.

What is claimed is:

1. A cylinder head construction for a combustion engine, which comprises:

a wall structure defining a cylinder head lower surface adapted to contact a mating surface of a cylinder block, said wall structure having a combustion chamber wall defining a combustion chamber;

an exhaust port defining wall connected at one end to said wall structure and at the opposite end to a cylinder head side wall, and defining an exhaust passage within a cylinder head, said exhaust passage opening into said combustion chamber through two exhaust openings provided within said wall structure, and having two discrete passages corresponding each said exhaust opening near the wall structure;

a first coolant passage means defined between the wall structure and the exhaust port defining wall;

a second coolant passage means defined within a cylinder head at the opposite side of the first coolant passage means to said exhaust port defining wall;

a channel passage means defined within said exhaust port defining wall between said discrete passages, and communicating said first coolant passage and said second coolant passage together; and a wall member positioned below the exhaust port defining wall and extending between the exhaust port defining wall and the wall structure for deflecting a coolant, flowing in the first coolant passage means, so as to flow into said channel passage means.

2. The construction as claimed in claim 1, further comprising bolt receiving walls each having a bolt receiving hole defined therein for the passage of a respective bolt used to connect the cylinder head and the cylinder block together, said bolt receiving walls being continuously formed with the exhaust port defining wall.

3. The construction as claimed in claim 1, wherein the exhaust ports adapted to be selectively opened and closed by the two exhaust valves, respectively, are aggregated together within the cylinder head and wherein the wall member is continued to a portion of the exhaust port defining wall downstream of the point where the exhaust ports are aggregated, said wall member extending down to the wall structure.

4. The construction as claimed in claim 1, wherein said wall member is positioned substantially intermediately of the distance between neighboring two bolts.

5. The construction as claimed in claim 1, wherein the combustion engine is a multi-cylinder engine having a row of engine cylinders, and wherein the cylinder head has first and second ends opposite to each other in a direction longitudinally of the engine, said first and second ends being formed with coolant inlet and outlet, respectively, the coolant which has entered into the cylinder head through the coolant inlet flowing towards the coolant outlet in a direction lengthwise of the engine, said wall member projecting into said flow of said coolant.

6. The construction as claimed in claim 5, wherein the wall member is inclined relative to the direction of the flow of the coolant.

7. The construction as claimed in claim 1, further comprising two camshafts, one associated with the exhaust valves and the other associated with at least one intake valve, and a spark plug positioned between the intake and exhaust valves and having an electrode tip confronting the combustion chamber at a location substantially centrally of the combustion chamber.

8. The construction as claimed in claim 1, further comprising bolt receiving walls each having a bolt receiving hole defined therein for the passage of a respective bolt used to connect the cylinder head and the cylinder block together, said bolt receiving walls being continuously formed with the exhaust port defining wall, and wherein the exhaust ports adapted to be selectively opened and closed by the two exhaust valves, respectively, are aggregated together within the cylinder head and wherein the wall member is continued to a portion of the exhaust port defining wall downstream of the point where the exhaust ports are aggregated, said wall member extending down to the wall structure.

* * * * *